US011753894B1

(12) United States Patent
Baghdady et al.

(10) Patent No.: US 11,753,894 B1
(45) Date of Patent: Sep. 12, 2023

(54) DOWNHOLE THROUGH-TUBING VIBRATION TOOL, SYSTEM AND METHOD

(71) Applicant: Saudi Arabian Oil Company, Dhahran (SA)

(72) Inventors: Waleed Mohamed Baghdady, Abqaiq (SA); Victor Jose Bustamante Rodriguez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/736,616

(22) Filed: May 4, 2022

(51) Int. Cl.

| | |
|---|---|
| ***E21B 31/107*** | (2006.01) |
| ***E21B 37/00*** | (2006.01) |
| ***E21B 28/00*** | (2006.01) |
| ***E21B 21/00*** | (2006.01) |
| ***E21B 31/00*** | (2006.01) |
| ***E21B 41/00*** | (2006.01) |

(52) U.S. Cl.
CPC ..... *E21B 31/107* (2013.01); *E21B 28/00* (2013.01); *E21B 37/00* (2013.01); *E21B 21/00* (2013.01); *E21B 31/005* (2013.01); *E21B 41/0085* (2013.01)

(58) Field of Classification Search
CPC ..... E21B 31/107; E21B 28/00; E21B 37/00; E21B 21/00; E21B 31/005; E21B 41/0085
See application file for complete search history.

(56) References Cited

U.S. PATENT DOCUMENTS

| | | | | |
|---|---|---|---|---|
| 4,667,742 | A | 5/1987 | Bodine | |
| 4,890,682 | A | 1/1990 | Worrall et al. | |
| 6,502,638 | B1 * | 1/2003 | Stoesz | E21B 31/113 166/301 |
| 6,866,104 | B2 | 3/2005 | Stoesz et al. | |
| 7,011,156 | B2 | 3/2006 | von Gynz-Rekowski | |
| 7,575,051 | B2 | 8/2009 | Stoesz et al. | |
| 9,453,410 | B2 * | 9/2016 | Logan | E21B 47/18 |
| 10,508,496 | B2 | 12/2019 | Kutinsky et al. | |
| 2010/0212901 | A1 | 8/2010 | Buytaert | |
| 2010/0276204 | A1 | 11/2010 | Connell et al. | |
| 2013/0168080 | A1 * | 7/2013 | Powell | E21B 7/24 166/177.6 |
| 2016/0258254 | A1 * | 9/2016 | Guo | H02K 35/02 |
| 2019/0040703 | A1 * | 2/2019 | Costa de Oliveira | E21B 28/00 |
| 2020/0217160 | A1 * | 7/2020 | Samuel | B06B 1/16 |
| 2021/0062633 | A1 * | 3/2021 | Amoudi | E21B 17/1014 |
| 2021/0140259 | A1 * | 5/2021 | Kjøsnes | E21B 31/107 |
| 2022/0341273 | A1 * | 10/2022 | Al-Mousa | E21B 31/107 |

FOREIGN PATENT DOCUMENTS

| | | |
|---|---|---|
| WO | WO 2020208327 | 10/2020 |

* cited by examiner

*Primary Examiner* — Robert E Fuller
*Assistant Examiner* — Neel Girish Patel
(74) *Attorney, Agent, or Firm* — Fish & Richardson P.C.

(57) ABSTRACT

A downhole tool includes a main body configured to be disposed by a conveyance member within a tubing string disposed in a wellbore drilled into a subterranean zone, and a plurality of hammers disposed about a central axis of the main body, each of the plurality of hammers configured to reciprocate radially with respect to the central axis. The tool also includes a plurality of electric motors, each of the plurality of electric motors configured to drive the reciprocation of a respective one of the plurality of hammers, such that each of the electric motors can cause a respective hammer to repetitively strike an interior surface of the tubing string and thereby impart vibration in the tubing string.

20 Claims, 7 Drawing Sheets

DOWNHOLE THROUGH-TUBING VIBRATION TOOL, SYSTEM AND METHOD

TECHNICAL FIELD

This disclosure relates to the production of oil, gas, or other resources from subterranean zones to the surface.

BACKGROUND

Hydrocarbons trapped in subsurface reservoirs can be raised to the surface of the Earth (that is, produced) through wellbores formed from the surface to the subsurface reservoirs. Wells for hydrocarbon production or other applications can be completed and made ready for production by cementing a casing within the wellbore and inserting a production tubing string within the casing. Hydrocarbons or other fluids can be produced from a subterranean formation up through the production tubing string.

In some circumstances, it is desirable or necessary to dislodge, loosen, or remove cement, debris, stuck tools, or other materials or objects which have been intentionally or unintentionally emplaced within or around tubulars or other components of a well.

SUMMARY

Certain aspects of the subject matter herein can be implemented as a downhole tool. The tool includes a main body configured to be disposed by a conveyance member within a tubing string disposed in a wellbore drilled into a subterranean zone, and a plurality of hammers disposed about a central axis of the main body, each of the plurality of hammers configured to reciprocate radially with respect to the central axis. The tool also includes a plurality of electric motors, each of the plurality of electric motors configured to drive the reciprocation of a respective one of the plurality of hammers, such that each of the electric motors can cause a respective hammer to repetitively strike an interior surface of the tubing string and thereby impart vibration in the tubing string.

An aspect combinable with any of the other aspects can include the following features. The downhole tool can also include a fluid flow passage disposed within the main body and turbine disposed in the main body and configured to be rotated by a flow of fluid through the fluid flow passage. The tool can also include an alternator disposed in the main body and configured to convert the rotation of the turbine into electricity, wherein the electricity from the alternator drives each of the plurality of electric motors.

An aspect combinable with any of the other aspects can include the following features. An axis of the turbine can be coaxial with the central axis of the main body.

An aspect combinable with any of the other aspects can include the following features. The tool can be configured to permit fluid to flow from an uphole end of the tool through the fluid flow passage and exit the tool at a downhole end of the tool.

An aspect combinable with any of the other aspects can include the following features. The conveyance member can be a tubular conveyance member. The downhole tool can be connected to a downhole end of the tubular conveyance member, and the fluid flowed through the flow passage can comprise the fluid flowed through the tubular conveyance member.

An aspect combinable with any of the other aspects can include the following features. The downhole tool can be configured to be run into the tubing string by the tubular conveyance member.

An aspect combinable with any of the other aspects can include the following features. The tubing string can be a kill string.

An aspect combinable with any of the other aspects can include the following features. The tool can further include a plurality of centralizer blades disposed radially about the main body. The plurality of hammers can include plurality of subsets of hammers, and each subset of hammers can be disposed in a respective one of the plurality of centralizer blades.

An aspect combinable with any of the other aspects can include the following features. The hammers of each subset of hammers can be stacked vertically within the respective one of the plurality of centralizer blades.

Certain aspects of the subject matter herein can be implemented as a system. The system includes a tubular conveyance member configured to be disposed within a tubing string disposed in a wellbore drilled into a subterranean zone, and a downhole tool disposed on a downhole end of the tubular conveyance member. The downhole tool includes a main body configured such that a central axis of the main body is parallel with an axis of the tubing string when the tool is disposed in the tubing string, a fluid flow passage within the main body, and a turbine disposed in the main body and configured to be rotated by a flow of fluid from the tubular conveyance member through the fluid flow passage. The tool also includes an alternator disposed in the main body and configured to convert the rotation of the turbine into electricity, a plurality of hammers disposed radially about the central axis of the main body, and a plurality of electric motors, each of the plurality of electric motors configured to, when actuated by electricity from the alternator, cause a respective hammer of the plurality of hammers to reciprocate radially with respect to the central axis, wherein the reciprocation of the plurality of the hammers causes the plurality of hammers to repetitively strike an interior surface of the tubing string and thereby impart vibration in the tubing string.

An aspect combinable with any of the other aspects can include the following features. The downhole tool can further include a plurality of centralizer blades disposed radially about the main body. The plurality of hammers can include a plurality of subsets of hammers, and each subset of hammers can be disposed in a respective one of the plurality of centralizer blades.

An aspect combinable with any of the other aspects can include the following features. The hammers of each subset of hammers can be stacked vertically within the respective one of the plurality of centralizer blades.

Certain aspects of the subject matter herein can be implemented as a method of dislodging a material deposit from a tubing string disposed in a wellbore drilled into a subterranean zone. The method includes disposing, by a tubular conveyance member, a downhole tool to a downhole location within the tubing string proximate the material deposit. The downhole tool is attached to a downhole end of the tubular conveyance member and includes a main body having a central axis parallel with an axis of the tubing string, a fluid flow passage within the main body, a power system, and a plurality of hammers disposed radially about the central axis of the main body. Each of the plurality of hammers is configured to reciprocate radially with respect to the central axis in response to activation of the power system. The method further includes flowing, through the tubular conveyance member and thence through the flow passage, a fluid, thereby activating the power system and causing the reciprocation of each of the plurality of hammers, which causes a repetitive striking of an interior surface of the tubing string by the plurality of hammers and dislodging, by vibration imparted in the tubing string by the repetitive striking, the material deposit.

An aspect combinable with any of the other aspects can include the following features. The method can further include flowing the fluid from a downhole end of the downhole tool and through gaps in or around the deposit of cement caused by the dislodging of the material deposit.

An aspect combinable with any of the other aspects can include the following features. The method can further include transporting, by the flow of the fluid, pieces of the dislodged material deposit.

An aspect combinable with any of the other aspects can include the following features. The power system can include a turbine disposed in the main body and configured to be rotated by a flow of fluid from the tubular conveyance member through the fluid flow passage, an alternator disposed in the main body and configured to convert the rotation of the turbine into electricity, and a plurality of electric motors, each of the plurality of electric motors configured to, when actuated by electricity from the alternator, cause a respective hammer of the plurality of hammers to reciprocate radially with respect to the central axis. Activating the power system can include rotating, by the flow of fluid flowing through the flow passage, the turbine, thereby causing, by electricity from the alternator, each electric motor to drive the reciprocation of a respective hammer.

An aspect combinable with any of the other aspects can include the following features. A portion of the material deposit can be, prior to the dislodging, attached to an exterior surface of the tubing string, and wherein the downhole location within the tubing string to which the downhole tool is disposed is at the same measured depth in the wellbore as, and is across a wall of the tubing strong from, the portion of the material deposit.

An aspect combinable with any of the other aspects can include the following features. A portion of the material deposit can be, prior to the dislodging, attached to an interior surface of the tubing string, and the downhole location within the tubing string to which the downhole tool is disposed can be uphole of the portion of the material deposit.

An aspect combinable with any of the other aspects can include the following features. The downhole tool can further include a plurality of centralizer blades disposed radially about the main body and the plurality of hammers can include a plurality of subsets of hammers, and each subset of hammers can be disposed in a respective one of the plurality of centralizer blades.

An aspect combinable with any of the other aspects can include the following features. The hammers of each subset of hammers can be stacked vertically within the respective one of the plurality of centralizer blades.

The details of one or more embodiments are set forth in the accompanying drawings and the description below. Other features, objects, and advantages will be apparent from the description, drawings, and claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

In some circumstances, it may be necessary or desirable to crack, dislocate, remove, or otherwise dislodge cement or other material deposits from within or around tubulars, annuli, or other spaces or locations within the well systems. However, the dislodgement of such cement or other debris can be challenging to remove in a cost-effective, efficient manner. For example, removal of cement plugs or other cement or debris can in some circumstances require costly drilling through the cement plug, and even with the bottom end of the cement plug removed, cement can remain in annular or other spaces. In accordance with embodiments of the present disclosure, an efficient and cost effective tool, system, and method for dislodgement of cement plugs and other material deposits is disclosed that is efficient and cost-effective. Furthermore, the disclosed tool, system, and method can wash away or otherwise transport pieces or particles of the dislodged materials from the interior of a tubing string and also the annular space exterior to the tubing string. By utilizing the simple, single tool as disclosed, intervention time and equipment requirements, and the risk of leaving junk or lost tools in the holes, can be reduced.

Figure 1:
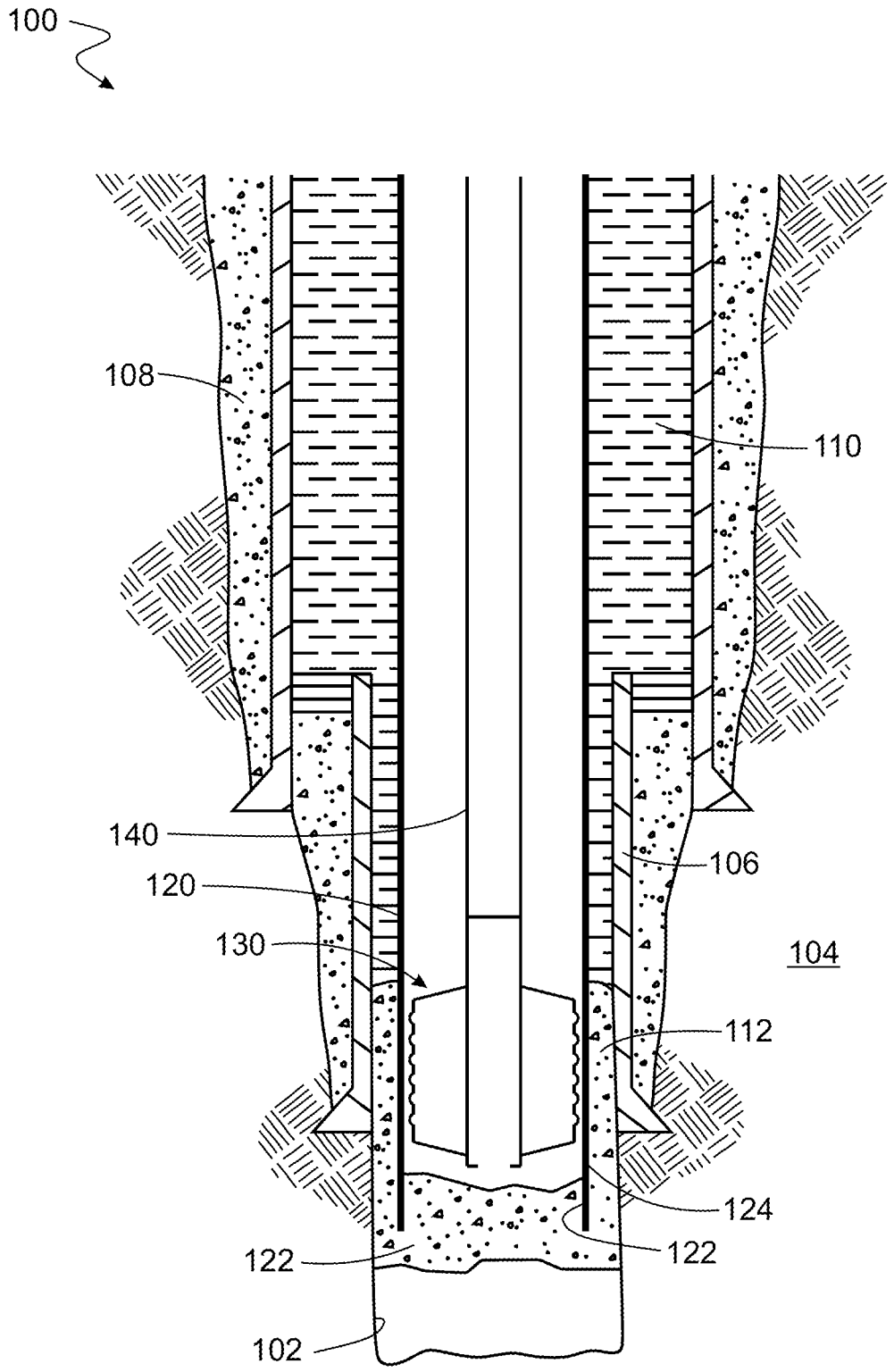
FIG. 1 is a schematic illustration of a well system in accordance with an embodiment of the present disclosure.

FIG. 1 is a schematic illustration of a well system in accordance with an embodiment of the present disclosure. Referring to FIG. 1, well system 100 includes a wellbore 102 drilled into a subterranean zone 104. A casing string 106 comprises a plurality of casing segments that have been cemented into the wellbore using conventional methods. Specifically, in accordance with such conventional methods, cement 108 can be pumped down the central bore of casing string 106 after it has been positioned at its final depth. The cement 108 exits the bottom end of casing string 106 and travels upwards to fill the annulus between casing string 106 and wellbore 102. Wellbore 102 can in some embodiments be partially or fully vertical, partially or fully horizontal, or partially or fully other than vertical or horizontal.

Tubing strings such as drill strings, production strings, and kill strings can, in some circumstances, be disposed within casing string 106 or otherwise within wellbore 102. For example, after installation of casing string 106, a drill string (not shown) can be disposed in the wellbore within casing string 106 to further drill wellbore 102, and if desired or necessary, further lengths of casing installed in the wellbore. After drilling is complete, the drill string can be removed and a production tubing string (not shown) can be installed in wellbore 102 within casing string 106. A production tubing string can comprise lengths of tubing connected to each other and can act as the primary conduit through which oil, gas, or other fluids are produced to the surface. A displacement fluid 110 can fill the space between the inner surface of casing string 106 and a tubing string disposed within casing string 106.

As described above, it may be desirable or necessary in some circumstances to dislodge, loosen, or remove cement, debris, stuck tools, objects, or other materials which have been intentionally or unintentionally emplaced within or around tubulars or other components of a well. For example, in some circumstances, it is necessary or desirable to temporarily or permanently close a wellbore, such as wellbore 102, by emplacing a plug or other material deposit, and it may subsequently be necessary or desirable to remove or dislodge the material deposit. In the illustrated embodiment, for example, tubing string 120 is a kill string that has been disposed in wellbore 102 for purposes of plugging the wellbore by emplacing a material deposit (specifically, cement plug 150) at the downhole end of the kill string. Cement plug 150 is at least partially adhered to inner surface 122 and outer surface 124 of tubing string 120 and fills the end of tubing string 120 and, also, at least a portion of the annulus 112 between wellbore 102 (or casing string 106) and tubing string 120 proximate the downhole end of tubing string 120, thereby sealing annulus 112 and tubing string 120 at the downhole end of tubing string 120, preventing the flow of fluid through both the annulus and through kill string 106.

In the illustrated embodiment, in accordance with some embodiments of the present disclosure, vibration tool 130 is disposed in tubing string 120 in the wellbore 102 by a conveyance member 140. In the illustrated embodiment, conveyance member 140 is a tubular conveyance member, such as coiled tubing or a string of pipe segments. In other embodiments, conveyance member 140 can be or can include a slickline, wireline, or a robotic conveyance device. As described in more detail with respect to the following figures and the accompanying text, vibration tool 130 can in some embodiments include a plurality of hammers disposed about a central axis of a main body, with each of the plurality of hammers configured to reciprocate radially with respect to the central axis. Vibration tool 130 can further include a plurality of electric motors, with each of the plurality of electric motors configured to drive the reciprocation of a respective one of the plurality of hammers, such that each of the electric motors can cause a respective hammer to repetitively strike an interior surface of the tubing string and thereby impart vibration in the tubing string. In some embodiments, vibration tool 130 can be the vibration tool as described in greater detail in reference to FIGS. 2A and 2B.

Figure 2A:
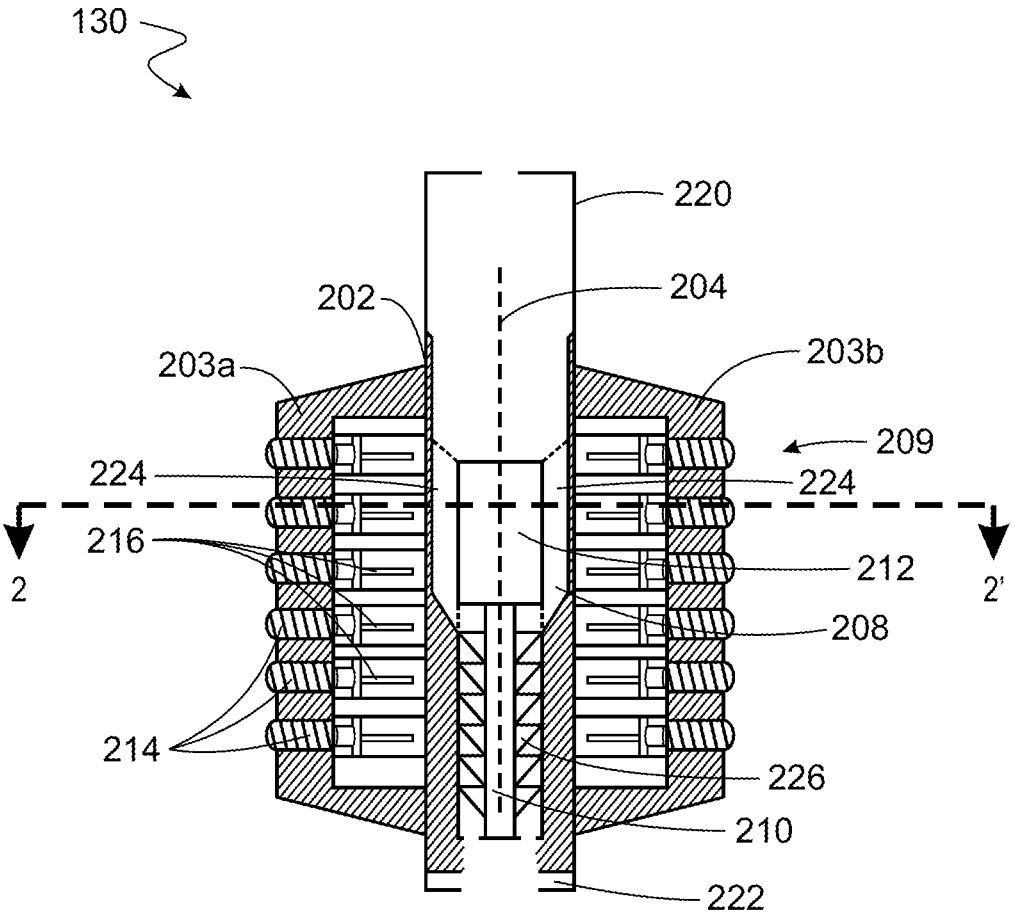
FIGS. 2A and 2B are schematic illustrations of a downhole vibration tool in accordance with an alternative embodiment of the present disclosure.
Figure 2B:
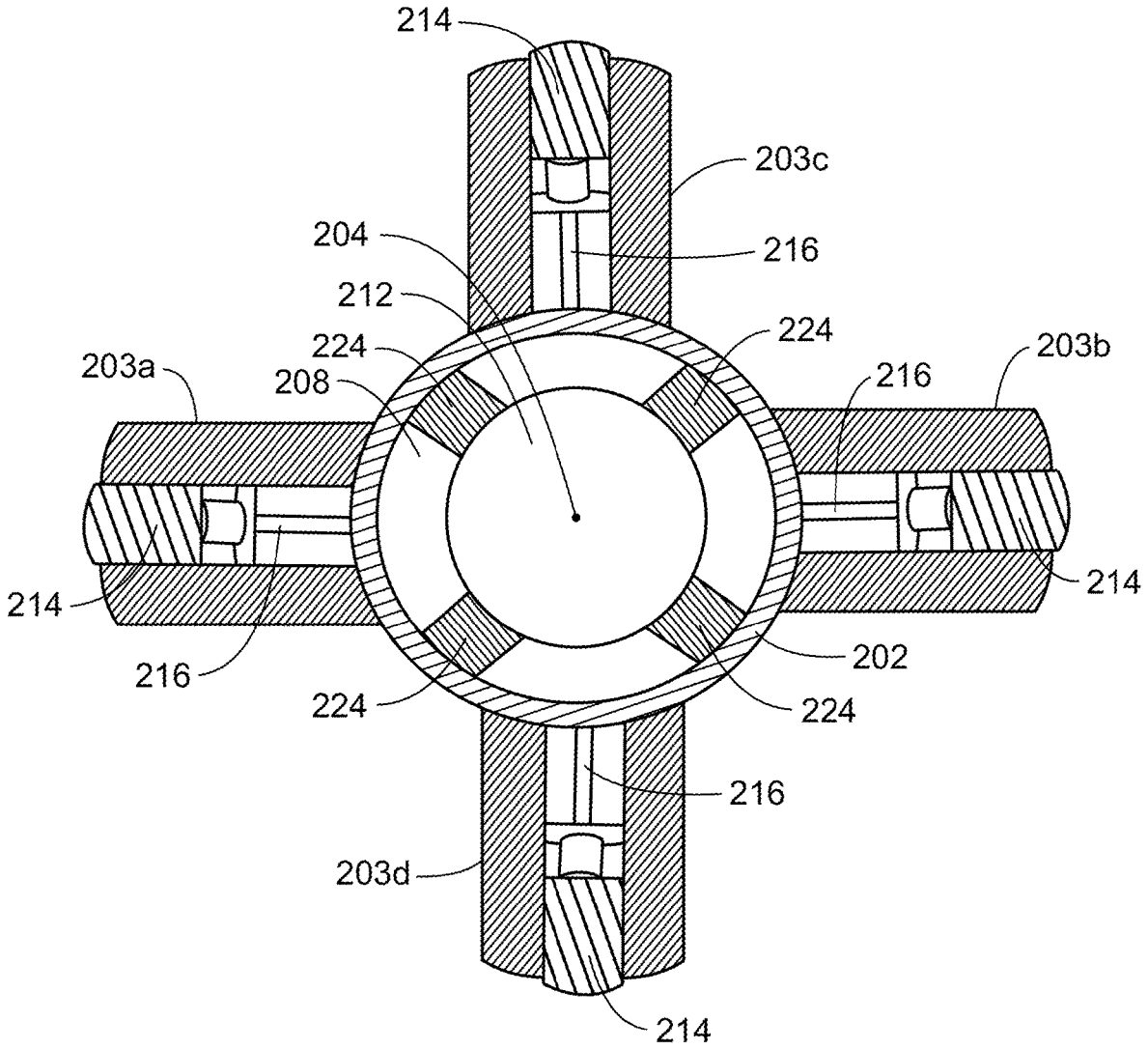

FIGS. 2A and 2B are schematic illustrations of vibration tool 130 in accordance with an embodiment of the present disclosure. In some embodiments, vibration tool 130 of FIG. 1 can include some or all of the elements described in reference to FIGS. 2A and 2B, and/or can include other, fewer, or additional elements.

Referring to FIG. 2A, vibration tool 130 includes a main body 202 with a fluid flow passage 208 therethrough, from which radially extend a plurality of centralizer blades 203*a* and 203*b*. A plurality of hammers 214 are disposed radially within respective centralizer blades 203*a* and 203*b* about the central axis 204 of main body 202. Specifically, in the illustrated embodiment, the plurality of hammers is divided into subsets, and the hammers of each subset are disposed and stacked vertically within their respective blades. Each of the plurality of hammers 214 is configured to reciprocate radially with respect to central axis 204 in response to activation of a power system 209. Power system 209 in the illustrated embodiment includes a turbine 210 disposed in main body 202. Turbine 210 includes turbine blades 226 and is configured to be rotated by a flow of fluid through the fluid flow passage 208. Alternator 212 is disposed in main body 202 and is configured to convert the rotation of the turbine 210 into electricity. In the illustrated embodiment, the axis of turbine 210 is also the axis of (i.e., it is coaxial with) central axis 204 of main body 202. Power system 209 further includes a plurality of electric motors 216, each of which is connected to a respective hammer 214. Electric motors 216 are configured to, when actuated by electricity from the alternator 212, cause a respective hammer 214 to reciprocate radially with respect to the central axis 204. In the illustrated embodiment, each electric motor 216 is disposed within the respective blade within which the respective hammer powered by the electric motor is disposed, behind (i.e., radially inward from) the respective hammer. In some embodiments, the electric motors can be disposed in another suitable location within tool 130. In the illustrated embodiment, each motor powers a single hammer; in some embodiments, a single electric motor can power more than one hammer.

A plurality of legs 224 connect alternator 212 with main body 202. Legs 224 and main body 202 can include ports or passageways through which can be disposed power cables and other wiring connecting alternator 212 with electric motors 216, thus isolating the cables and wiring from corrosive wellbore fluids or otherwise harmful downhole conditions.

As described below in greater detail, the hammers 214 reciprocating radially can repetitively strike—and thereby impart vibration in—a tubular or other component or member in which tool 130 is disposed or is proximate to. The impacts from the hammers 214 and the resulting vibration can dislodge or loosen cement or other debris or materials and/or loosen or free stuck tubular members or other downhole components, such as stuck tools or tubing strings, from or within a wellbore or other locations within a well system. In some embodiments, alternator 212 can be an alternator of similar or same design to that used in measurement-while-drilling (MWD) and logging-while-drilling (LWD) tools. Electric motors 216 can, in some embodiments, be DC motors of a type selected based on downhole pressure and temperature conditions.

In the illustrated embodiment, tool 130 is configured such that fluid can flow in a downhole direction from an uphole end 220 of tool 130 through fluid flow passage 208 (which includes the spaces between legs 224) and then exit the tool 130 at a downhole end 222 of tool 130. The fluid can flow through gaps imparted in the cement or other materials loosed or dislodged by the vibration, thus restoring fluid flow through the system (for example, through the tubing string in which the tool is disposed and/or through the annulus on the exterior of the tubing string). Furthermore, as described in greater detail below, the fluid flowed through the tool can act to not only drive rotation of turbine 210 but also to wash away or otherwise transport pieces of cement or other materials or debris broken, dislodged or loosened by the vibration imparted by the tool 130.

FIG. 2B is a cross-sectional view of tool 130 across 2-2' as shown in FIG. 2A. The illustrated embodiment includes four centralizer blades—203*a*, 203*b*, 203*c*, and 203*d*—extending radially from main body 202, in a rotationally symmetrical configuration equidistant from each other. Each blade in the illustrated embodiment includes a subset of a plurality of hammers 214 which, as described above, are configured to reciprocate radially with respect to the central axis 204. Each of the hammers 214 driven by a respective motor 216, thereby repetitively striking the inner surface of a tubing string or other enclosure within which the tool is disposed. Some embodiments can include a greater or lesser number of centralizer blades (for example, three blades or five blades) with respective sets of hammers disposed in similar or different geometries as shown in FIG. 2A. Alternator 212 is disposed within fluid flow passage 208, such that a portion of fluid flow passage 208 circumferentially surrounds alternator 212. Fluid can flow through fluid flow passage 208 between legs 224 around alternator 212 to the bottom end of the tool.

In some embodiments, hammers 214 can be configured to reciprocate at a frequency of five-hundred to three-thousand reciprocations per minute or another suitable frequency and to strike at suitable kinetic energies, depending on the downhole conditions such as fluid type and viscosity and the nature of the downhole components and of the cement or other blockage. In some embodiments, hammers 214 all reciprocate in unison with each other. In some embodiments, some or all of hammers 214 reciprocate other than in unison; for example, in sequence or randomly with respect to each other.

Figure 3:
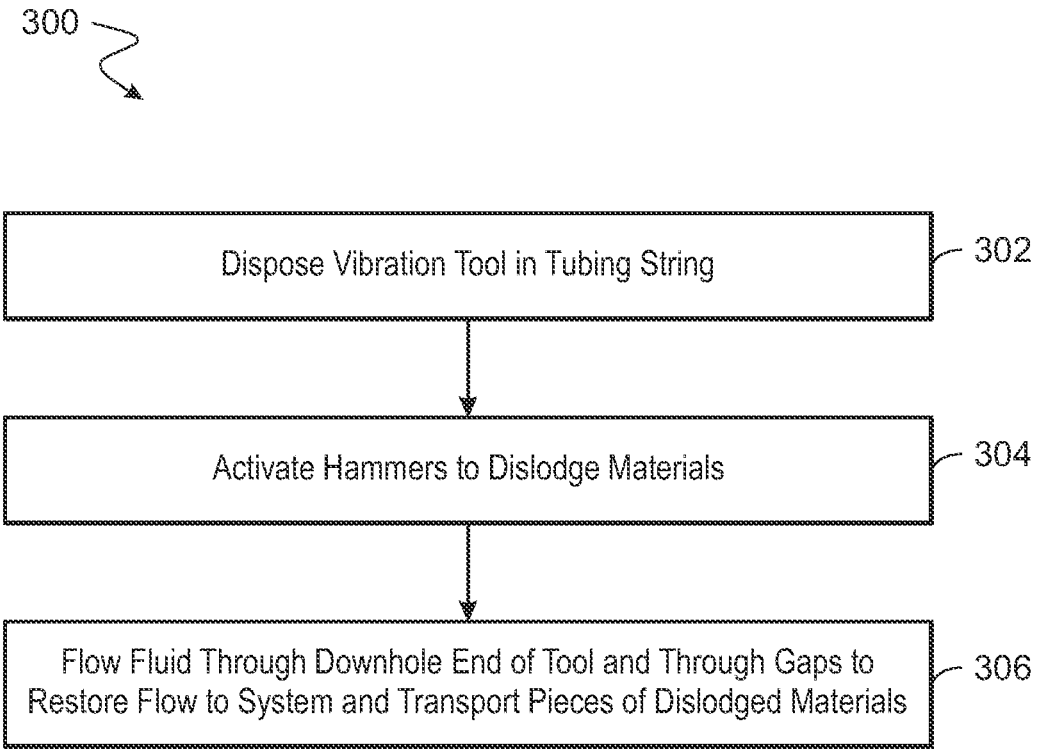
FIG. 3 is a process flow diagram of a method of operating a downhole vibration tool in accordance with an embodiment of the present disclosure.
Figure 4A:
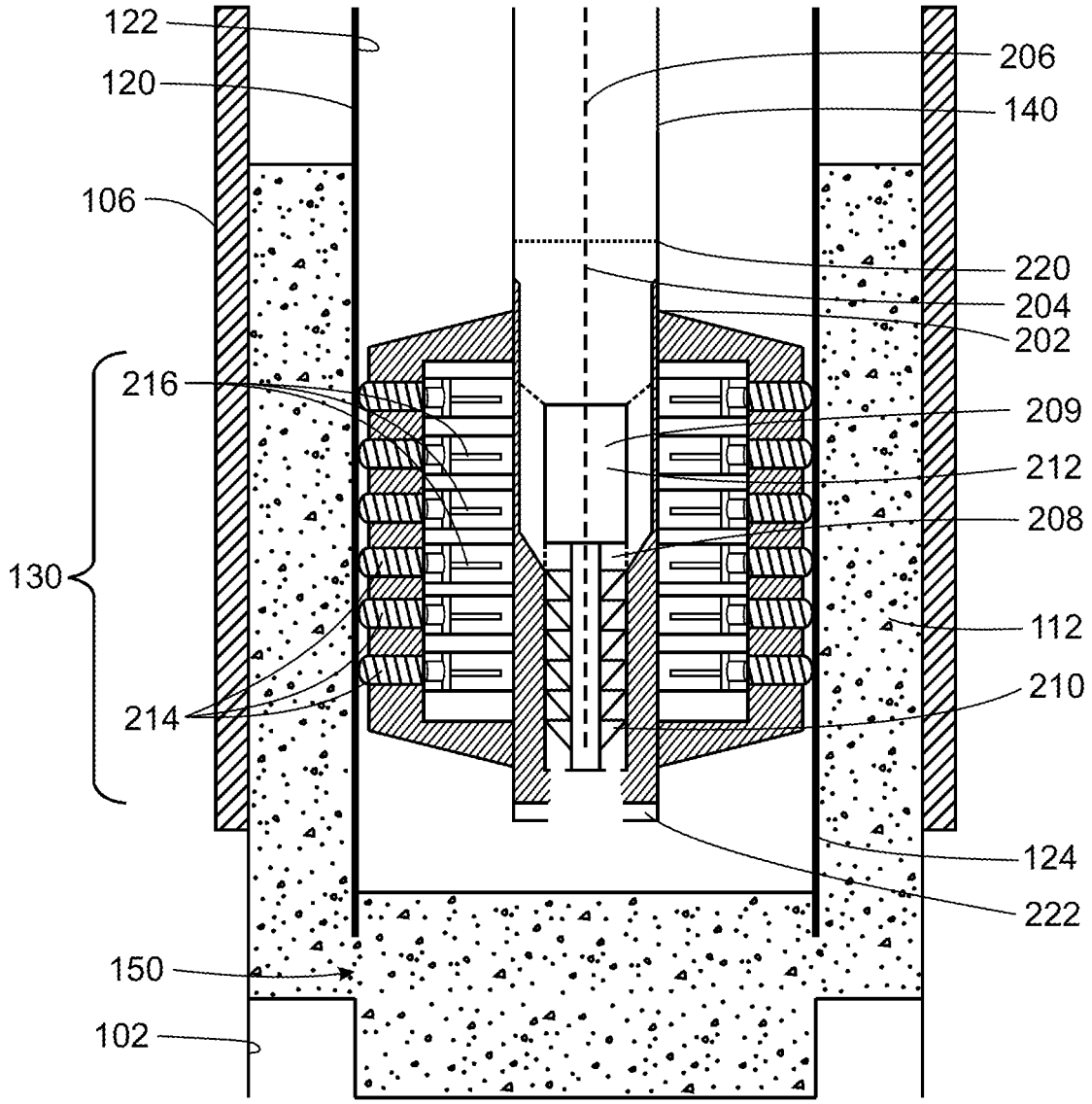
FIGS. 4A-4C are schematic illustrations of the downhole vibration tool at different steps of a method of the present invention, in accordance with an embodiment of the present disclosure.
Figure 4B:
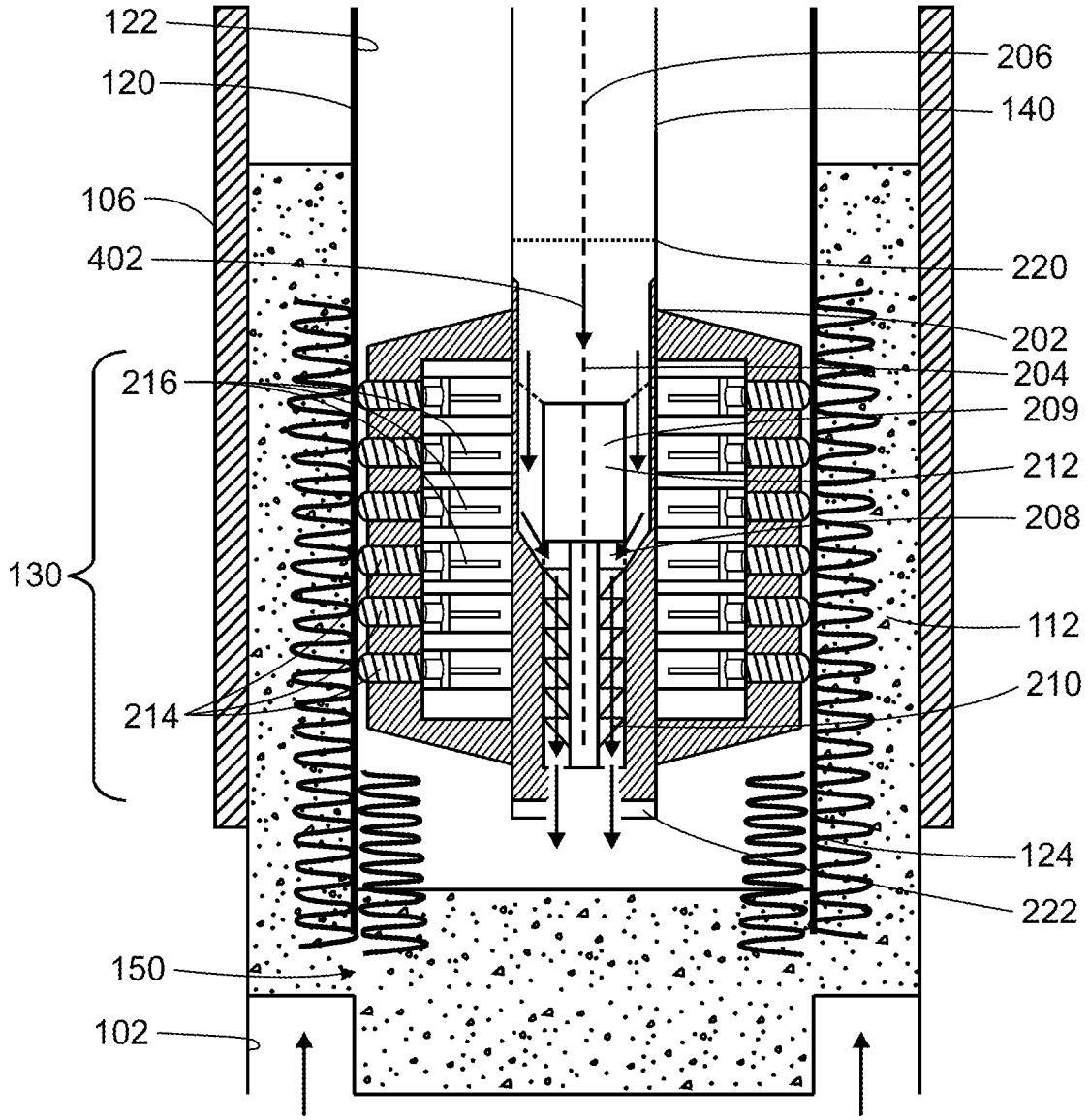
Figure 4C:
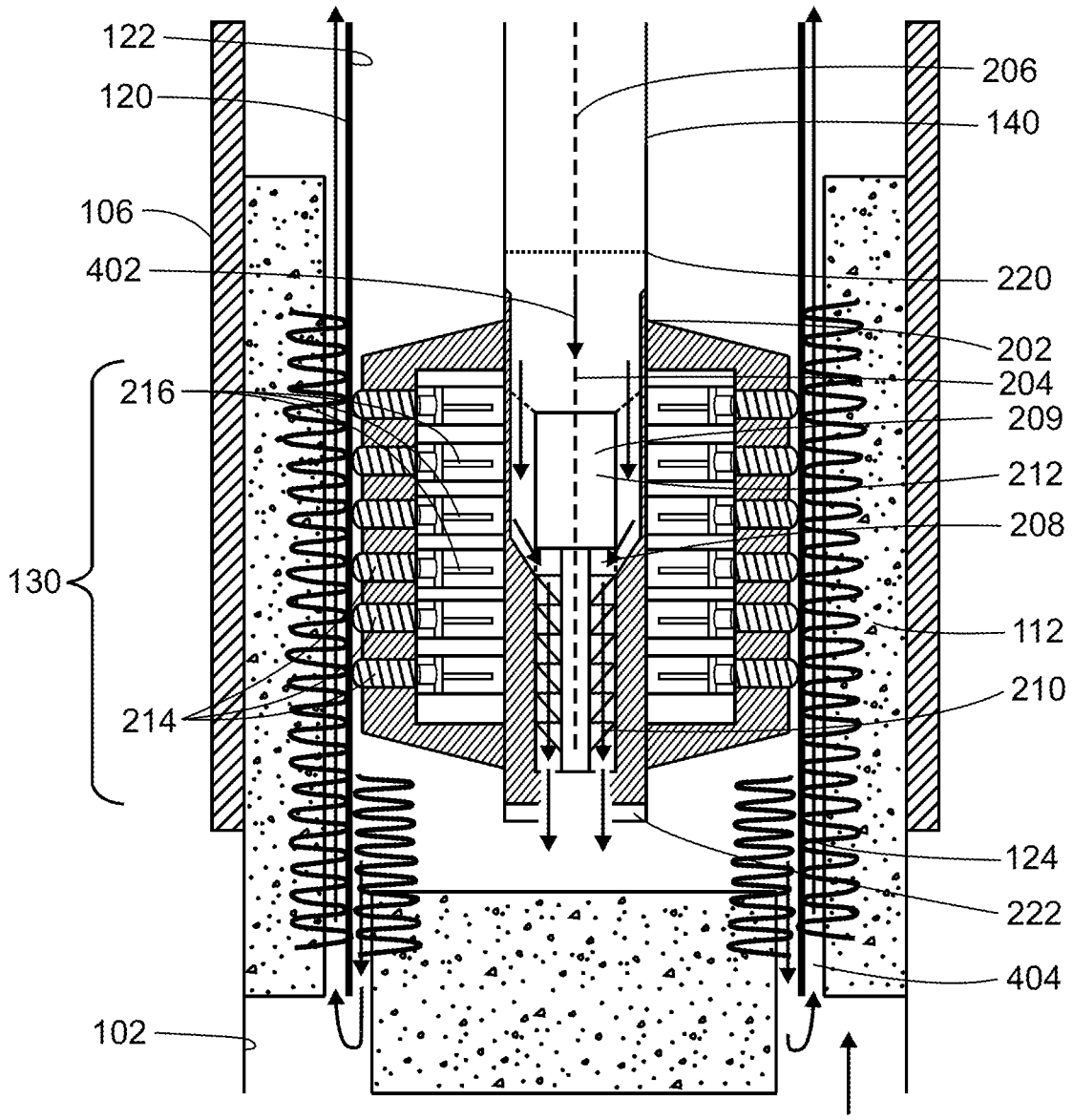

FIG. 3 is a process flow diagram of a method 300 of dislodging a deposit of cement from a surface of a tubing string disposed in a wellbore drilled into a subterranean zone. The method of FIG. 3 will be described by reference to the system 100 and tool 130 as described in reference to FIGS. 2A and 2B; however, it will be understood that FIG. 3 may be applicable to tools and systems in accordance with other embodiments of the present disclosure. FIGS. 4A-4C are schematic illustrations of tool 130 within system 100 at different steps of the method of FIG. 3.

Referring to FIG. 3, and as illustrated in FIG. 4A, method 300 begins at step 302 wherein vibration tool (such as tool 130) attached to a downhole end of conveyance member (such as tubular conveyance member 140) is disposed at a downhole location within the tubing string (such as tubing string 120) proximate a deposit of cement or other debris or materials, such as cement plug 150. In the embodiment shown in FIG. 4A, tubing string 120 is a kill string and has been disposed within wellbore 102 in which a casing string 106 has been installed, as also illustrated in FIG. 1. As shown in FIG. 4A, main body 202 is configured such that a central axis 204 of main body 202 is parallel with an axis 206 of tubing string 120 when tool 130 is disposed in tubing string 120.

In the illustrated embodiment, a portion of cement plug 150 is adhered to outer surface 124 of tubing string 120 and another portion is within and adhered to inner surface 122 of tubing string 120. In the illustrated embodiment, the downhole location within the tubing string at which tool 130 is disposed is at the same measured depth in the wellbore as, and is across a wall of the tubing strong from, a portion of cement plug 150 that is adhered to outer surface 124, and uphole of a portion of cement plug 150 that is adhered to an inner surface 122.

Proceeding to step 304, and as shown in FIG. 4B, fluid is flowed through tubular conveyance 140 and thence through flow passage 208. The flow of fluid through flow passage 208 causes rotation of turbine 210 of power system 209. Alternator 212 converts the rotation of the turbine 210 into electricity. Electricity from alternator 212 actuates electric motors 216, each of which, in turn, causes radial reciprocation of a respective hammer 214. Reciprocating hammers 214 repetitively strike the interior surface 122 of tubing string 120, thereby imparting vibration in tubing string 120. The vibrations can loosen and/or dislodge a portion or all of cement plug 150 within tubular string 120 below tool 130 and/or within annulus 112 across the wall of tubular string 120 from tool 130.

Proceeding to step 306, and as shown in FIG. 4B, fluid 402 is continued to be flowed through tubular conveyance 140, through flow passage 208, exiting tool 130 at its downhole end 222. The fluid 402 can flow through fissures, cracks, openings, or other gaps 404 imparted in or around cement plug 150, thereby restoring fluid flow through the downhole end of tubing string 120 and through annulus 112. Fluid 402 flowing from downhole end 222 of tool 130 can also wash away or otherwise transport pieces of cement plug 150 dislodged or broken by the vibration imparted by the tool 130.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool comprising:

a main body configured to be disposed by a conveyance member within a tubing string disposed in a wellbore drilled into a subterranean zone;

a plurality of hammers disposed about a central axis of the main body, each of the plurality of hammers configured to reciprocate radially with respect to the central axis;

a plurality of electric motors, each of the plurality of electric motors configured to drive the reciprocation of a respective one of the plurality of hammers, such that each of the electric motors can cause a respective hammer to repetitively strike an interior surface of the tubing string and thereby impart vibration in the tubing string.

2. The downhole tool of claim 1, further comprising:

a fluid flow passage disposed within the main body;

a turbine disposed in the main body and configured to be rotated by a flow of fluid through the fluid flow passage;

an alternator disposed in the main body and configured to convert the rotation of the turbine into electricity, wherein the electricity from the alternator drives each of the plurality of electric motors.

3. The downhole tool of claim 2, wherein an axis of the turbine is coaxial with the central axis of the main body.

4. The downhole tool of claim 2, wherein the tool is configured to permit fluid to flow from an uphole end of the tool through the fluid flow passage and exit the tool at a downhole end of the tool.

5. The downhole tool of claim 2, wherein:

the conveyance member is a tubular conveyance member;

the downhole tool is connected to a downhole end of the tubular conveyance member; and the fluid flowed through the flow passage comprises fluid flowed through the tubular conveyance member.

6. The downhole tool of claim 5, wherein the downhole tool is configured to be run into the tubing string by the tubular conveyance member.

7. The downhole tool of claim 1, wherein the tubing string is a kill string.

8. The downhole tool of claim 1, further comprising a plurality of centralizer blades disposed radially about the main body, wherein the plurality of hammers comprises a plurality of subsets of hammers, and wherein each subset of hammers is disposed in a respective one of the plurality of centralizer blades.

9. The downhole tool of claim 8, wherein the hammers of each subset of hammers are stacked vertically within the respective one of the plurality of centralizer blades.

10. A system comprising:

a tubular conveyance member configured to be disposed within a tubing string disposed in a wellbore drilled into a subterranean zone;

a downhole tool disposed on a downhole end of the tubular conveyance member, the downhole tool comprising:

a main body configured such that a central axis of the main body is parallel with an axis of the tubing string when the tool is disposed in the tubing string;

a fluid flow passage within the main body;

a turbine disposed in the main body and configured to be rotated by a flow of fluid from the tubular conveyance member through the fluid flow passage;

an alternator disposed in the main body and configured to convert the rotation of the turbine into electricity;

a plurality of hammers disposed radially about the central axis of the main body; and a plurality of electric motors, each of the plurality of electric motors configured to, when actuated by electricity from the alternator, cause a respective hammer of the plurality of hammers to reciprocate radially with respect to the central axis, wherein the reciprocation of the plurality of the hammers causes the plurality of hammers to repetitively strike an interior surface of the tubing string and thereby impart vibration in the tubing string.

11. The system of claim 10, wherein the downhole tool further comprises a plurality of centralizer blades disposed radially about the main body, wherein the plurality of hammers comprises a plurality of subsets of hammers, and wherein each subset of hammers is disposed in a respective one of the plurality of centralizer blades.

12. The system of claim 11, wherein the hammers of each subset of hammers are stacked vertically within the respective one of the plurality of centralizer blades.

13. A method of dislodging a material deposit from a tubing string disposed in a wellbore drilled into a subterranean zone, the method comprising:

disposing, by a tubular conveyance member, a downhole tool to a downhole location within the tubing string proximate the material deposit, the downhole tool attached to a downhole end of the tubular conveyance member and comprising:

a main body having a central axis parallel with an axis of the tubing string;

a fluid flow passage within the main body;

a power system;

a plurality of hammers disposed radially about the central axis of the main body, each of the plurality of hammers configured to reciprocate radially with respect to the central axis in response to activation of the power system; and flowing, through the tubular conveyance member and thence through the flow passage, a fluid, thereby activating the power system and causing the reciprocation of each of the plurality of hammers, thereby causing a repetitive striking of an interior surface of the tubing string by the plurality of hammers and dislodging, by vibration imparted in the tubing string by the repetitive striking, the material deposit.

14. The method of claim 13, further comprising flowing the fluid from a downhole end of the downhole tool and through gaps in or around the deposit of cement caused by the dislodging of the material deposit.

15. The method of claim 13, further comprising transporting, by the flow of the fluid, pieces of the dislodged material deposit.

16. The method of claim 13, wherein:

the power system comprises:

a turbine disposed in the main body and configured to be rotated by a flow of fluid from the tubular conveyance member through the fluid flow passage;

an alternator disposed in the main body and configured to convert the rotation of the turbine into electricity; and a plurality of electric motors, each of the plurality of electric motors configured to, when actuated by electricity from the alternator, cause a respective hammer of the plurality of hammers to reciprocate radially with respect to the central axis;

and wherein activating the power system comprises rotating, by the flow of fluid flowing through the flow passage, the turbine, thereby causing, by electricity from the alternator, each electric motor to drive the reciprocation of a respective hammer.

17. The method of claim 13, wherein a portion of the material deposit is, prior to the dislodging, attached to an exterior surface of the tubing string, and wherein the downhole location within the tubing string to which the downhole tool is disposed is at the same measured depth in the wellbore as, and is across a wall of the tubing strong from, the portion of the material deposit.

18. The method of claim 13, wherein a portion of the material deposit is, prior to the dislodging, attached to an interior surface of the tubing string, and the downhole location within the tubing string to which the downhole tool is disposed is uphole of the portion of the material deposit.

19. The method of claim 13, wherein the downhole tool further comprises a plurality of centralizer blades disposed radially about the main body, wherein the plurality of hammers comprises a plurality of subsets of hammers, and wherein each subset of hammers is disposed in a respective one of the plurality of centralizer blades.

20. The method of claim 19, wherein the hammers of each subset of hammers are stacked vertically within the respective one of the plurality of centralizer blades.

* * * * *